US005329995A

United States Patent [19]

Dey et al.

[11] Patent Number: 5,329,995

[45] Date of Patent: Jul. 19, 1994

[54] HEAT EXCHANGER ASSEMBLY I

[75] Inventors: LaVoyce Dey, Youngsville, Pa.; Sigurd Case, Frewsburg, N.Y.

[73] Assignee: Valeo Engine Cooling Incorporated, Jamestown, N.Y.

[21] Appl. No.: 937,502

[22] Filed: Aug. 28, 1992

[51] Int. Cl.[5] ..... F28F 9/04

[52] U.S. Cl. ..... 165/153; 165/173; 165/174; 29/890.052

[58] Field of Search ..... 165/153, 173, 174, 175, 165/176; 29/890.052

[56] References Cited

U.S. PATENT DOCUMENTS

| | | | |
|---|---|---|---|
| 4,615,385 | 10/1986 | Saperstein et al. | 165/173 |
| 4,917,180 | 4/1990 | Wolf et al. | 165/175 |
| 4,971,145 | 11/1990 | Lyon | 165/173 |
| 5,036,914 | 8/1991 | Nishishita et al. | 165/153 |
| 5,042,578 | 8/1991 | Tanabe | 165/174 |
| 5,052,480 | 10/1991 | Nakajima et al. | 165/153 |
| 5,097,900 | 3/1992 | Yamaguchi | 165/173 |
| 5,107,926 | 4/1992 | Calleson | 165/173 |
| 5,119,552 | 6/1992 | Sutou et al. | 29/890.052 |
| 5,125,454 | 6/1992 | Creamer et al. | 165/173 |
| 5,195,579 | 3/1993 | Buchanan | 165/149 |
| 5,207,738 | 5/1993 | Dey | 165/175 |
| 5,259,449 | 11/1993 | Case | 165/173 |

FOREIGN PATENT DOCUMENTS

| | | | |
|---|---|---|---|
| 450619 | 10/1991 | European Pat. Off. | 165/173 |

*Primary Examiner*—John Rivell
*Assistant Examiner*—L. R. Leo
*Attorney, Agent, or Firm*—Morgan & Finnegan

[57] ABSTRACT

A heat exchanger in which a header and tank construction comprises separate header and tank portions which are used in combination to form a heat exchanger unit. End caps for the header and tank construction and baffles to form partitions or chambers within the header and tank construction are inserted in grooves formed in the separate header and/or tank portion(s). The heat exchanger assembly comprises spaced combined header and tank constructions between which extend a plurality of tubes which are inserted in slots in the header portions. An area of the header portion can have a plurality of center portions and slots between adjacent center portions for the tubular elements. The apexes of each center portion between the tubular element slots have a flattened area and there are side portions running downward from the center portion apex flats which also are substantially flattened.

15 Claims, 3 Drawing Sheets

HEAT EXCHANGER ASSEMBLY I

BACKGROUND OF THE INVENTION

Heat exchangers which employ two spaced header and tank constructions and wherein generally paralleled, open ended tubes interconnect the header and tank constructions and are in fluid communication with the interior of the header and tank constructions are known. Plate or serpentine fins can be disposed across the tubes between the header and tank constructions. These heat exchangers can be used in vehicular radiators and air conditioner condensers, evaporators and the like.

Structural improvements in such heat exchangers are desired to enhance the ease of manufacture and reduce the cost of manufacture and manpower while maintaining or improving durability and reliability. A round tube (1 pc) is always lighter. Lighter and more effective heat exchangers especially for vehicular radiators and air conditioners are sought after advantages.

OBJECTS AND SUMMARY OF THE INVENTION

The present invention seeks to achieve the improvements which have been sought after by the prior art as pointed out.

The present invention relates to a heat exchanger and, more particularly, to a heat exchanger in which a header and tank construction comprises separate header and tank portions which are used in combination to form a heat exchanger unit. End plates for the header and tank construction and baffle plates to form partitions within the header and tank construction are inserted in grooves formed in the separate header and/or tank portion(s). The heat exchanger comprises spaced combined header and tank constructions between which extend a plurality of tubes which are inserted in slots in the header portions.

In a preferred embodiment, a tubular header and tank constructions has a header or tube member receiving portion which has a plurality of elongated tube-member receiving slots and center portions between the slots wherein each center portion has a substantially flat apex portion and substantially flat side portions extending transversely from each flat apex portion. Extending longitudinally from each center portion is a camming surface for facilitating the insertion of tube-members into the slots. Each camming surface extends longitudinally from a center portion toward the slots adjacent to the center portion. A flat may also be contained in the interior surface of the tube receiving surfaces just opposite to the center portion apex flat. A boss can be contained on the header and tank construction exterior surface opposite the tube member receiving surface to facilitate the holding of the header and tank construction during the tube insertion process.

DETAILED DESCRIPTION OF THE INVENTION

The heat exchanger of the present invention comprises spaced generally parallel header and tank constructions and a plurality of tubular elements whose opposite ends are connected to the header and tank construction.

Each of the header and tank constructions comprise a separate header portion and a separate tank portion. The separate header portion and separate tank portion are adapted to be joined to form the header and tank constructions of the present heat exchanger. The ends of the header and tank constructions are closed with end plates which are inserted in grooves formed in the inner surfaces at or adjacent the ends of the separate header portions and the separate tank portions.

A core assembly comprising tubular elements between which are placed serpentine spacers is inserted in elongated, spaced receiving slots in the separate header portion surfaces of the header and tank constructions.

The slots of one header portion of the assembly are aligned and face corresponding slots in the other separate header portion surface and the tubular elements extend between the header and tank constructions through the aligned slots of the separate header portions.

The heat exchanger assembly may contain partitioned areas or chambers within the separate header and tank constructions. The partitions are formed by baffle plates within the header and tank construction which divide the header and tank construction into separate chambers.

Grooves for the baffles are provided in the separate header portion and the separate tank portions into which the baffle may be inserted.

The portions of the header surfaces bordering each of the elongated slots for the tubular members and generally above the slots comprise center portions each of which have a chordal substantially flat area at an apex thereof and side portions which have a substantially flattened area running transversely along the header surface. The apex flat and the transverse side portion flats in conjunction with a camming surface integral with the side portions aid in creating a steep funnel effect for camming the tubular members into the header slots. The elongated slots between the center and side portions with flats are defined by the camming surface bordering each of the elongated slots. The presence of a steep entry provided by the camming surface is important for high speed assembly of many tubes at a time into the matching slots of the header constructions. The present invention prevents and/or minimizes damage to the tube walls and ends.

The apex flats also produce more uniformity of dimension of the fillets with the walls closer for better bonding and joint strength.

The header and tank construction of the present invention can also include bosses on the base surface of the header and tank construction opposite the apex flat of the center portions. The opposing boss helps the header to be grabbed and held in the correct rotational and parallel position during perpendicular insertion of tubes and brackets.

In a further embodiment of the present invention, an inside flat is automatically created in the stamping operation. A punch die used in the stamping that holds the metal of the header construction against deformation is flat to resist the punch. A similar inside flat advantageously helps locate the baffles for high speed production.

The ends of the header portion can have (end) aligning tabs which can be bent over to lock together the separate header portion and separate tank portions. To maintain proper alignment of the header portion this portion can have tabs which can be wedged against the tank portion in a header and tank construction.

The tabs on the header portion side are preferably adjacent to grooves in the header portion for the baffle plates.

In order to facilitate placement of end caps, a portion of an end of the header portions can be downwardly sloped to provide or lead-in for the end caps.

DETAILED DESCRIPTION OF THE FIGURES

Figure 1:
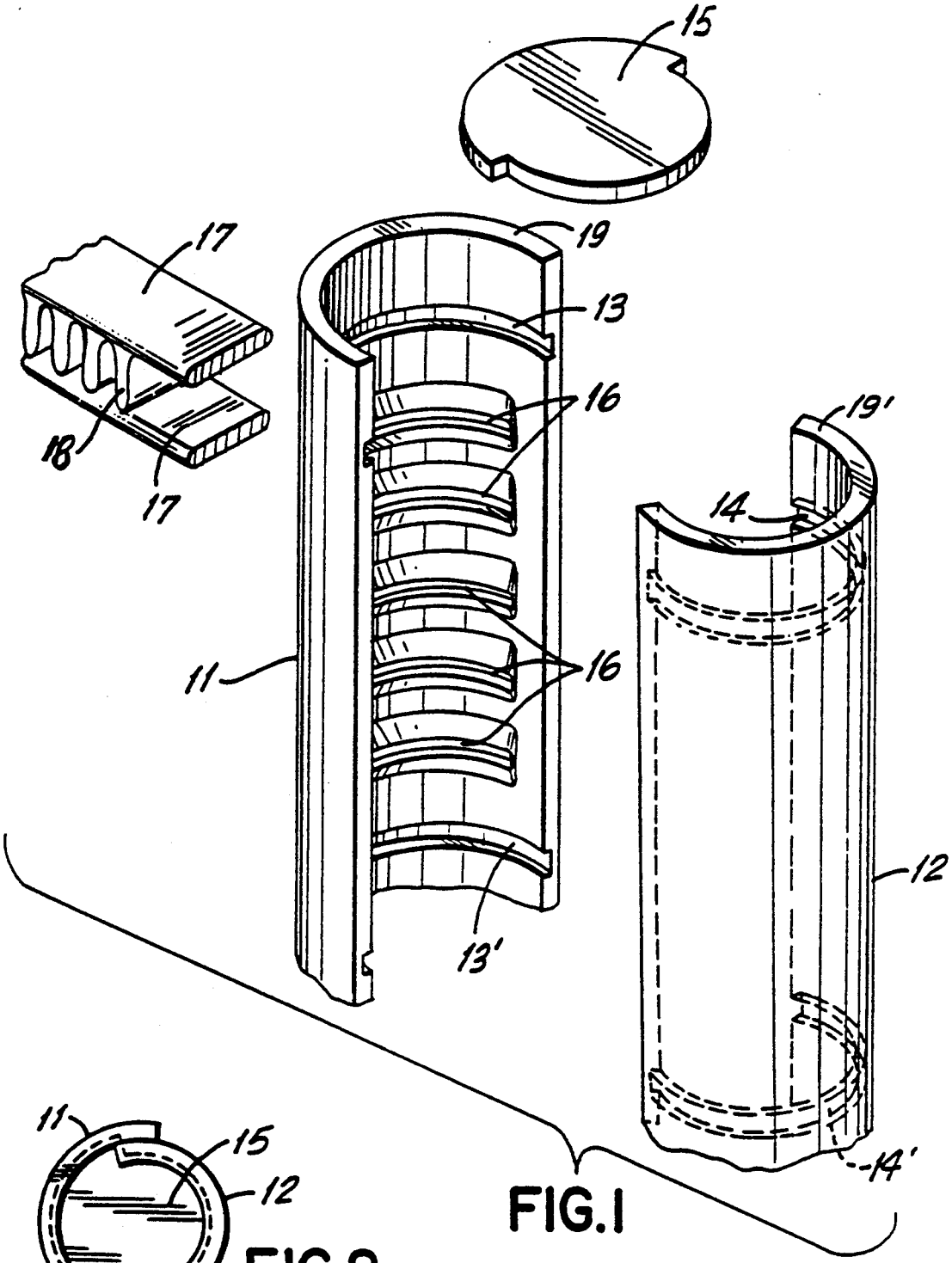
FIG. 1 shows a perspective view of the heat exchanger according to the present invention.

FIG. 1 is a perspective view of a heat exchanger in accordance with the present invention. The heat exchanger comprises a tank portion 12 and a header portion 11 which when joined in combination form one portion of the entire heat exchanger assembly. Tubes 17 separated by fins 18 are inserted into slots 16 in the header portion 11 of the heat exchanger assembly. A complete heat exchanger would comprise two header portion 11 and tank portion 12 combinations between which extend tubes 17, which are separated by fins 18, the tubes being inserted in slots 16 in the header portion 11 of each header portion 11/tank portion 12 combination.

Figure 2:
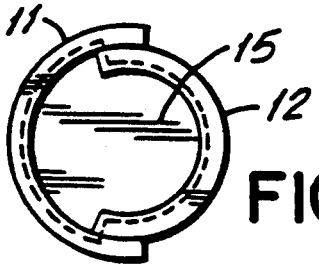
FIG. 2 shows a cross-sectional view of a present header and tank construction.

The header portion 11/tank portion 12 combination is closed on each end portion 19, 19' with an end plate 15. End plate 15 is inserted into grooves 13 and 14 in the head portion 11 and tank portion 12, respectively. FIG. 2 shows the header portion 11/tank portion 12 combination and the end plate 15 is showed in grooves 13 and 14 of the header and tank portions.

The head portion 11/tank portion 12 combination assemblies may also contain baffle plates. These baffle plates are similar in size and shape the end plate 15 and are also inserted in grooves 13' and 14' in header portion 11 and tank portion 12, respectively.

A heat exchanger assembly according to the present invention can be provided by inserting end plates (and baffle plates, if desired) 15 into grooves 13 (and 13' for the baffle plates) in the tank portion 11. An assembled multiplicity of tubes 17 and fins 18 are inserted into the appropriate slots 16 in the header portion 11 and the tank portion 12 is pressed into header portion 11.

Figure 3:
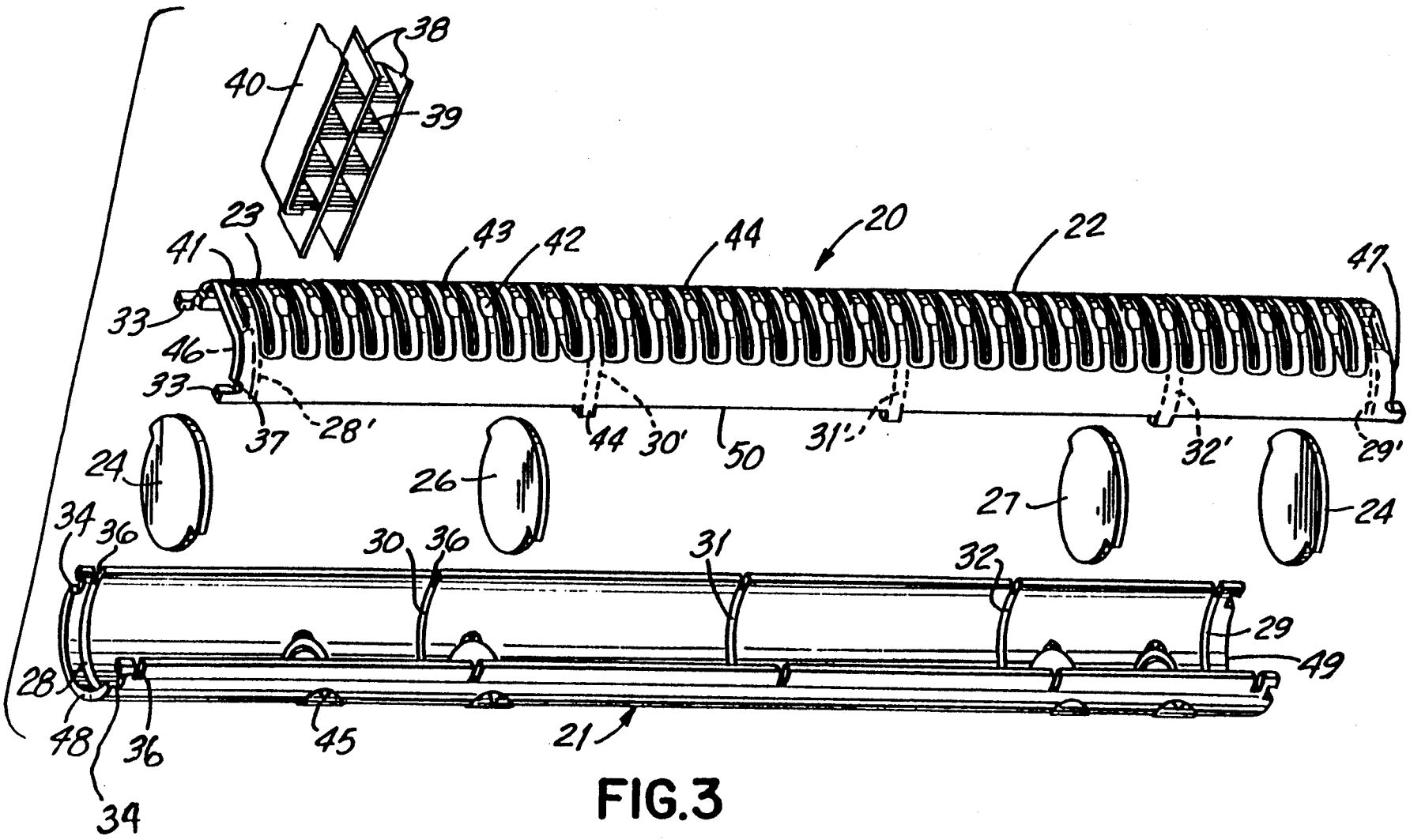
FIG. 3 shows a perspective view of another embodiment of the present invention in which the surface of the header contains ribs with flats.

FIG. 3 shows a perspective view of another embodiment of a heat exchanger assembly 20 according to the present invention. This embodiment comprises a tank portion 21 and a header portion 22 which in combination with end plates 24 and 25 and baffle plates 26 and 27 forms a subassembly into which a multiplicity of tubes 38 which are separated by fins 39 and having side plates 40 can be inserted into slots 23 in the header portion 22. The end plates 24 and 25 and baffle plates 26 and 27 are inserted into grooves 28, 29, 30, 31 and 32 which are manufactured in tank portion 21 and corresponding grooves 28', 29', 30', 31' and 32' manufactured in header portion 22. Header portion 22 and tank portion 21 can be formed from flat stock. The grooves for the baffle plates and end plates are manufactured into the material forming the header and tank portions. Bosses 45 can be formed into the tank portion 21 to form mounting surfaces for inlet, outlet tubes (not shown) and for mounting brackets (also not shown). In order to facilitate assembly of the heater exchanger, the ends 46, 47 of the header portion 22 may have end aligning tabs 33. After tank portion 21 is pressed into the header portion 22, the end aligning tabs 33 are bent over maintaining the alignment of the assembly. Notches 34 can be blanked into the ends 48, 49 of the tank portion 21 into which the end aligning tabs 33 of the header portion 22 can be bent thus aligning the assembly of header and tank portions together. Additionally tabs 44 can be provided on the sides 50 of the header portion 22 adjacent to grooves 30', 31' and 32' where baffle plates 26 and 27 are inserted. The tabs 44 can be wedged against the tank portion 21 when a baffle is located behind the tab insuring that the header/tank assembly is held together. If desired, end portions 46, 47 of the header portion may have a downward indentation 41 which is at end plate 24, 25 guide providing a lead-in for the end caps 24, 25 to assure complete seating in the receiver groove.

As can be seen in FIGS. 4 to 7, the header surface portion 22 is provided with a series of generally parallel elongated slots or holes 23 which receive the open ends of tubular elements 38. The tubular elements 38 can be sealed within the slots or holes 23 by any suitable means as well as bonded thereto sufficiently so as to provide structural integrity especially at such pressures as the heat exchanger assembly will be employed. Bosses 45 opposite apex flats 42 assist in holding the header during the insertion of the open ends of tubes 38 in slots 23 on header portion 22.

Figure 4:
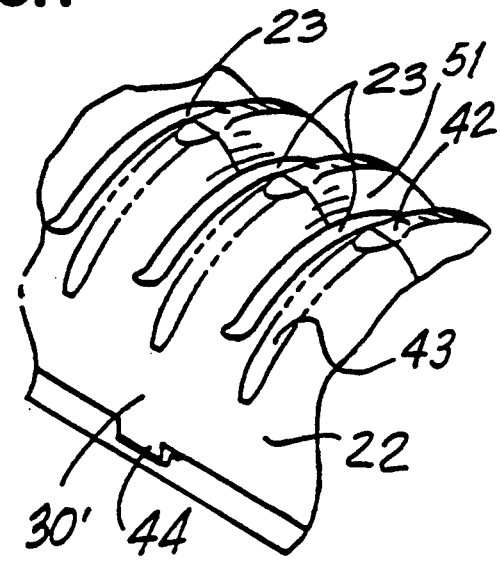
FIG. 4 is a closer view of a portion of the embodiment of FIG. 3 to better show the flat portions.

The portions of each header portion surface 22 between the elongated slots 23 comprise center portions which are disposed generally above said elongated slots 23. At the apex of each center portion is an apex flat 42 and a side portion and side portion flat 43 which runs downwardly from apex flat 42 in both directions from the apex thereof. The apex flat 42 and the downwardly generally circumferential side portion flat (chordal) 43 aid in creating a steep funnel effect for camming the tubes into the header slots. A camming surface 51 (FIG. 4) extends longitudinally from each center portion and the camming surfaces 51 (FIG. 4) extend inwardly in the header portion surface 22 (FIG. 4). Adjacent center portions 42 and 43 (FIG. 7) and the camming surfaces 51 define each of the elongated slots 23.

Figure 7:
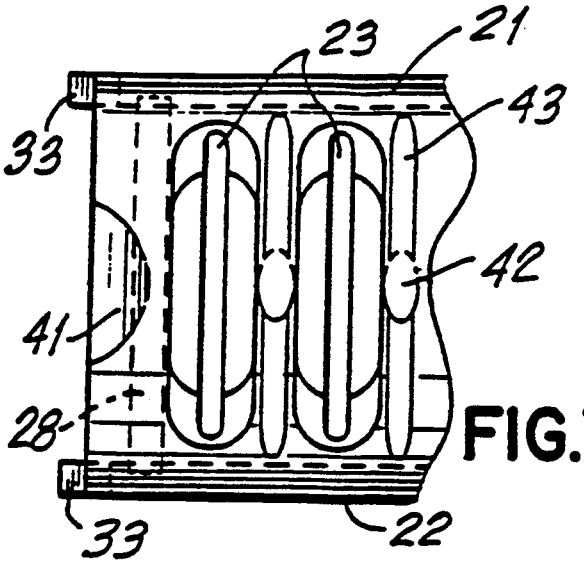
FIG. 7 is a top plan view of a portion of the embodiment shown in FIG. 4.
Figure 6:
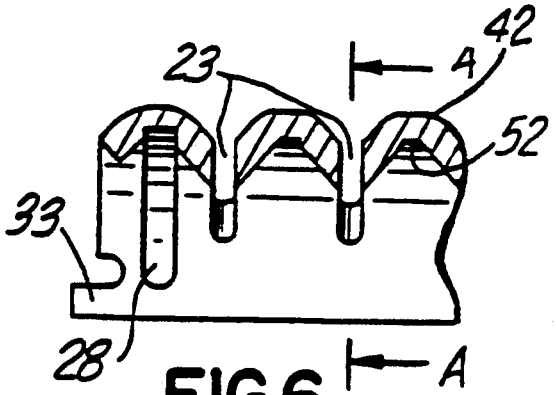
FIG. 6 is a cross-section of FIG. 5 through plane A—A.
Figure 5:
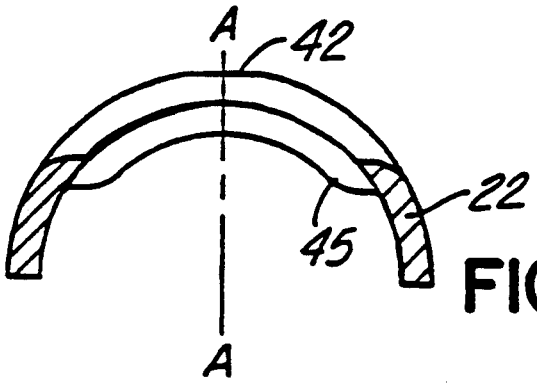
FIG. 5 is a section view of the FIG. 3 embodiment.

FIGS. 4, 5, 6 and 7 provide an enlarged view of a portion of header portion 22 to better illustrate the slot construction of the present invention. FIG. 4 is a perspective view of a portion of header surface portion 22 showing slots 23 and apex flats 42 and side portions and side portion flats 43. FIGS. 5, 6 and 7 show the same features as seen in FIG. 4 and provide different views of the header portion slot construction to provide a better understanding of the instant invention. Inside flat 52 opposite apex flats 42 are formed during the stamping operation forming the present header and tank construction.

The preferred header and tank construction of the present invention can be made in a two-step procedure. The elongated slots and center portion flats can be provided by a punching and stamping operation against a die in the interior of the header construction. In this step the elongated slots and center portions with apex flats are formed. The inside flat opposite the apex flat also occurs because of the presence of the die. A flattened area in the side portions between the slots can then be formed by pressing. These flattened portions in the interslot areas increase the funnel effect and enhance the manufacturability of the heat exchangers.

What is claimed is:

1. A heat exchanger comprising:

spaced generally parallel header and tank constructions;

a plurality of tubular elements whose opposite ends are connected to the header and tank constructions and extend between the header and tank constructions;

each of the header and tank constructions comprising a separate header portion and a separate tank portion, the separate header portion and separate tank portion being adapted to be joined to form the spaced generally parallel header and tank constructions of the heat exchanger; wherein ends of the header portion have end aligning tabs which can be bent over to align the separate header portion and separate tank portion; and end caps and at least one baffle plate which are inserted in grooves in an inner surface of the separate header portions and the separate tank portions; wherein tubular elements are inserted in elongated, spaced receiving slots in the separate header portion surfaces of the header and tank construction and side tabs are adjacent to grooves in the header portion for the baffle plates.

2. A heat exchanger according to claim 1, wherein the elongated slots are aligned and face corresponding slots in the other separate header portion surface and the tubular elements extend between the header and tank constructions through aligned slots of the separate header portions.

3. A heat exchanger according to claim 2 having a plurality of longitudinally spaced apart elongated slots for receiving tube members and a plurality of center portions disposed between a pair of slots; each center portion having a substantially flat apex portion and a pair of substantially flat circumferential side portions extending transversely from each substantially flat apex portion; and a camming surface for facilitating the insertion of tube members into said slots extending longitudinally from center portions toward each adjacent slot.

4. A heat exchanger according to claim 3, further comprising at least one boss on said tank portion wherein said boss is located opposite said substantially flat apex portion.

5. A heat exchanger according to claim 3, further comprising a flat on an inside surface of said header portion opposite said substantially flat apex portion.

6. A heat exchanger according to claim 3, wherein a side of the header portion has tabs which can be bent against the tank portion in a header and tank construction.

7. A heat exchanger according to claim 6, wherein the tabs are adjacent to grooves in the header portion for the baffle plates.

8. A heat exchanger according to claim 3, wherein a portion of an end of the header portions is downwardly sloped to provide or lead-in for the end plates.

9. A heat exchanger according to claim 3, wherein ends of the tank portion have a notch into which the tabs on the header portions can be bent to align the header portion and the tank portion.

10. A heat exchanger according to claim 1, wherein both end plates are inserted in grooves in an inner surface of at both ends of the separate header portions and the separate tank portion.

11. A heat exchanger according to claim 10, wherein at least one baffle plate is inserted within the header and tank construction for dividing the header and tank construction into separate partitions.

12. A heat exchanger according to claim 1, wherein at least one baffle plate is inserted within the header and tank construction for dividing the header and tank construction into separate partitions.

13. A heat exchanger according to claim 12 or 11, wherein grooves for the baffle plates are provided in the separate header portion and the separate tank portions into which the baffle plate may be inserted.

14. A heat exchanger according to claim 1, wherein a side of the header portion has tabs which can be bent against the tank portion in a header and tank construction.

15. A heat exchanger according to claim 1, wherein ends of the tank portions have a notch into which the tabs on the header portions can be bent to align the header portions and the tank portion.

* * * * *